US009520091B2

(12) United States Patent
He

(10) Patent No.: US 9,520,091 B2
(45) Date of Patent: Dec. 13, 2016

(54) LIQUID CRYSTAL CELL AND THE LIQUID CRYSTAL DISPLAY WITH THE SAME

(71) Applicant: Shenzhen China Star Optoelectronics Technology Co., Ltd., Shenzhen, Guangdong (CN)

(72) Inventor: Jhen-wei He, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 80 days.

(21) Appl. No.: 13/981,356

(22) PCT Filed: Jun. 24, 2013

(86) PCT No.: PCT/CN2013/077807
§ 371 (c)(1),
(2) Date: Jul. 24, 2013

(87) PCT Pub. No.: WO2014/201705
PCT Pub. Date: Dec. 24, 2014

(65) Prior Publication Data

US 2014/0368552 A1 Dec. 18, 2014

(30) Foreign Application Priority Data

Jun. 17, 2013 (CN) ..... 2013 1 0239841

(51) Int. Cl.
*G09G 3/36* (2006.01)
*G09G 5/10* (2006.01)

(52) U.S. Cl.
CPC ..... *G09G 3/36* (2013.01); *G09G 2310/06* (2013.01); *G09G 2320/0252* (2013.01); *G09G 2320/0257* (2013.01)

(58) Field of Classification Search
None
See application file for complete search history.

(56) References Cited

U.S. PATENT DOCUMENTS 5,126,868 A * 6/1992 Kizaki ..... G02F 1/13471 349/180
5,945,970 A * 8/1999 Moon ..... G09G 3/3648 345/211
6,567,062 B1 * 5/2003 Kudo ..... G09G 3/3648 345/89
6,753,835 B1 * 6/2004 Sakai ..... G09G 3/3648 345/100
7,508,367 B2 * 3/2009 O'Donnell ..... 345/90
(Continued)

*Primary Examiner* — Dismery Mercedes
(74) *Attorney, Agent, or Firm* — Andrew C. Cheng

(57) ABSTRACT

A liquid crystal (LC) cell and the liquid crystal display with the same are disclosed. The LC cell includes a first LC cell and a second LC cell arranged opposite to the first LC cell, wherein the first LC cell is a normally white cell, and the second LC cell is a normally black cell. A display brightness of the second LC cell is white when the display brightness of the first LC cell transforms from white to black. The display brightness of the first LC cell is white when the display brightness of the second LC cell transforms from black to white. By mixing the normally white cell and the normally black cell, the response time is enhanced. In addition, the tracking or blurring effects occurring for the moving objects are efficiently eliminated.

8 Claims, 4 Drawing Sheets

(56) References Cited

U.S. PATENT DOCUMENTS 7,733,311 B2 * 6/2010 Amundson ..... G02F 1/167 345/101
8,035,611 B2 * 10/2011 Sakamoto ..... G09G 3/3446 345/107
8,279,150 B2 * 10/2012 Kim et al. ..... 345/92
8,786,529 B1 * 7/2014 Chavez ..... G09G 3/36 345/102
2002/0036608 A1 * 3/2002 Hirakata ..... G02F 1/133604 345/87
2003/0043097 A1 * 3/2003 Shingai ..... G09G 3/3666 345/87
2003/0137521 A1 * 7/2003 Zehner ..... G02F 1/167 345/589
2004/0207649 A1 * 10/2004 Shih ..... G09G 3/3648 345/690
2005/0001812 A1 * 1/2005 Amundson et al. ..... 345/107
2005/0007389 A1 * 1/2005 Kumamoto ..... G09G 3/3406 345/690
2005/0088386 A1 * 4/2005 Kao ..... G02F 1/13624 345/87
2007/0070032 A1 * 3/2007 Chung ..... G09G 3/344 345/107
2007/0146264 A1 * 6/2007 Choi ..... G09G 3/3648 345/87
2007/0182885 A1 * 8/2007 Egi ..... G02F 1/133528 349/96
2007/0242030 A1 * 10/2007 Kim ..... G01J 1/46 345/102
2008/0180606 A1 * 7/2008 Chang ..... G02F 1/133555 349/96
2008/0284926 A1 * 11/2008 Akiyama ..... G09G 3/3648 349/36
2009/0002302 A1 * 1/2009 Koo et al. ..... 345/89
2009/0290081 A1 * 11/2009 Cho ..... G02F 1/136286 349/42
2010/0097449 A1 * 4/2010 Jeong ..... G02B 27/2214 348/59
2010/0283804 A1 * 11/2010 Sprague ..... G09G 3/344 345/690
2011/0063330 A1 * 3/2011 Bae ..... G09G 3/3413 345/690
2011/0116166 A1 * 5/2011 Jung ..... G02B 27/26 359/465
2013/0120678 A1 * 5/2013 Chao ..... G02F 1/01 349/34
2014/0002507 A1 * 1/2014 Ben-Chorin ..... G09G 3/3413 345/690

* cited by examiner

LIQUID CRYSTAL CELL AND THE LIQUID CRYSTAL DISPLAY WITH THE SAME

BACKGROUND OF THE INVENTION

1. Field of the Invention

Embodiments of the present disclosure relate to liquid crystal display (LCD) technology, and more particularly to a liquid crystal (LC) cell and the LCD with the same.

2. Discussion of the Related Art

Currently, LCDs have a strict requirement of response time, that is, the time the display brightness transforms from white to black or from black to white. Response time is a key factor when evaluating the display performance of the LCDs. The slow response time results in tracking effect for moving objects, such as moving ping-pong balls or fishing rods. In addition, edges of the image may be seriously blurred for the reason that the LCDs are hold-type displays.

Many solutions have been conceived to overcome the above effects. For example, the structure of the LC is enhanced to obtain a better response time, increasing the refresh rate from 120 Hz to 240 Hz, over-driving or impulsive driving methods, and motion estimate and motion compensation (MEMC) technology. However, the above solutions may occupy a large amount of resources, such as memory or storage, and thus introduce side effects, such as reducing the brightness of the LCD. On the other hand, the response time is still not comparable to organic light-emitting diode (OLED) or Plasma displays.

SUMMARY

The object of the claimed invention is to provide a mixed LC cell including a first LC cell and a second LC cell opposite to the first LCD cell. The first LC cell is the normally white cell, and the second LC cell is the normally black cell.

In one aspect, a LC cell includes: a first LC cell and a second LC cell arranged opposite to the first LC cell, wherein the first LC cell is a normally white cell, and the second LC cell is a normally black cell.

Wherein a display brightness of the second LC cell is white when the display brightness of the first LC cell transforms from white to black, and the display brightness of the second LC cell is black when the display brightness of the first LC cell transforms from black to white.

Wherein the display brightness of the first LC cell is white when the display brightness of the second LC cell transforms from black to white, and the display brightness of the first LC cell is black when the display brightness of the second LC cell transforms from white to black.

Wherein the display brightness of the first LC cell is white when the display brightness of the second LC cell transforms from black to white, and the display brightness of the first LC cell is black when the display brightness of the second LC cell transforms from white to black.

Wherein the time period for the diving voltage of the first LC cell is the same with that of the second LC cell, the driving voltage of the first LC cell remains at a high level for a first high time period and remains at a low level for a first low time period, the driving voltage of the second LC cell remains at the high level for a second high time period and remains at the low level for a second low time period, when the first high time period equals the first low time period, the second high time period equals to a sum of the second low time period and a response time for which the display brightness of the second LC cell transforms from white to black.

Wherein the LC cell includes a plurality of pixels arranged in a matrix form, and each of the pixels is driven by two gate lines and two data lines, a first gate line turns on a gate of a first transistor and a first data line provides data voltage to the pixels by a source of the first transistor when the display brightness of the LC cell transforms from white to black, and a second gate line turns on a gate of a second transistor and a second data line provides the data voltage to the pixel by a source of the second transistor when the display brightness of the LC cell transforms from black to white.

In another aspect, a liquid crystal display includes: a liquid crystal (LC) cell and a backlight module arranged opposite to the LC cell, the backlight module supplies light to the LC cell, and the LC cell includes a first LC cell and a second LC cell arranged opposite to the first LC cell, wherein the first LC cell is a normally white cell, and the second LC cell is a normally black cell.

Wherein a display brightness of the second LC cell is white when the display brightness of the first LC cell transforms from white to black, and the display brightness of the second LC cell is black when the display brightness of the first LC cell transforms from black to white.

Wherein the display brightness of the first LC cell is white when the display brightness of the second LC cell transforms from black to white, and the display brightness of the first LC cell is black when the display brightness of the second LC cell transforms from white to black.

Wherein the display brightness of the first LC cell is white when the display brightness of the second LC cell transforms from black to white, and the display brightness of the first LC cell is black when the display brightness of the second LC cell transforms from white to black.

Wherein the time period for the diving voltage of the first LC cell is the same with that of the second LC cell, the driving voltage of the first LC cell remains at a high level for a first high time period and remains at a low level for a first low time period, the driving voltage of the second LC cell remains at the high level for a second high time period and remains at the low level for a second low time period, when the first high time period equals the first low time period, the second high time period equals to a sum of the second low time period and a response time for which the display brightness of the second LC cell transforms from white to black.

Wherein the LC cell includes a plurality of pixels arranged in a matrix form, and each of the pixels is driven by two gate lines and two data lines, a first gate line turns on a gate of a first transistor and a first data line provides data voltage to the pixels by a source of the first transistor when the display brightness of the LC cell transforms from white to black, and a second gate line turns on a gate of a second transistor and a second data line provides the data voltage to the pixel by a source of the second transistor when the display brightness of the LC cell transforms from black to white.

DETAILED DESCRIPTION OF THE EMBODIMENTS

Embodiments of the invention will now be described more fully hereinafter with reference to the accompanying drawings, in which embodiments of the invention are shown.

Figure 1A:
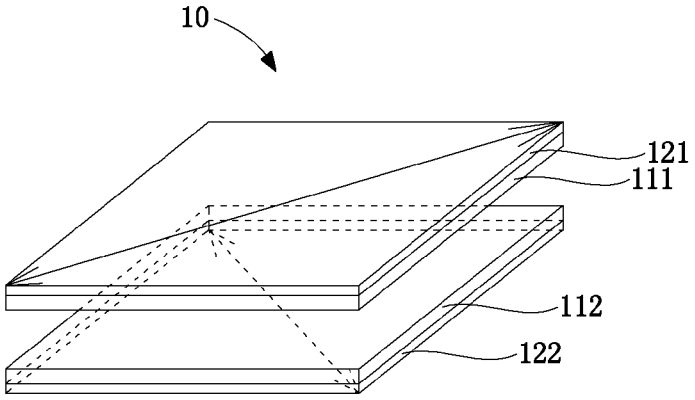
FIG. 1*a* is a schematic view of a normally white cell in accordance with one embodiment.
Figure 1B:
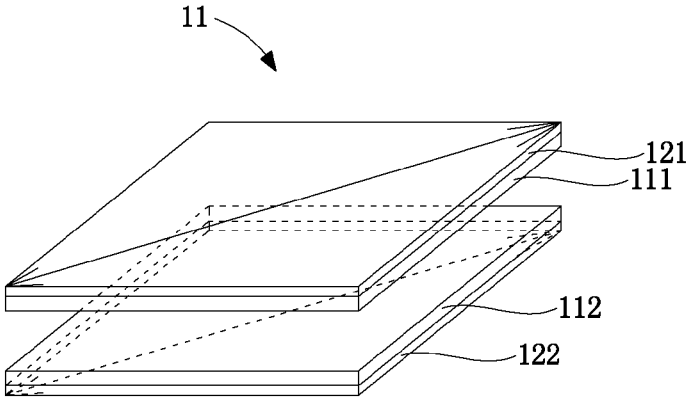
FIG. 1*b* is a schematic view of a normally black cell in accordance with one embodiment.

FIG. 1*a* is a schematic view of a normally white cell in accordance with one embodiment. FIG. 1*b* is a schematic view of a normally black cell in accordance with one embodiment.

As shown in FIG. 1*a*, the normally white cell 10 includes an up substrate 111, a down substrate 112, liquid crystal (not shown) filled in the normally white cell 10, an up polarizer 121, and a down polarizer 122. The up polarizer 121 and the down polarizer 122 respectively attach to an outer surface of the up substrate 111 and the down substrate 112. The up polarizer 121 and the down polarizer 122 are for allowing only the polarized beams with a certain polarized direction to pass through. In addition, the polarized directions of the up polarizer 121 and the down polarizer 122, as indicated by the solid and dashed arrow lines, are orthogonal to each other. When no voltage is applied, the beams radiated from a backlight module pass through such that the display brightness is white. When a voltage is applied, the beams irradiated from the backlight module are blocked such that the display brightness is black. Compared with FIG. 1*a*, the polarized directions of the up polarizer 121 and the down polarizer 122 of the normally black cell 11, as indicated by the solid and dashed arrow lines, are parallel to each other. When no voltage is applied, the beams radiated from the backlight module are blocked such that the display brightness is black. When the voltage is applied, the beams pass through and the display brightness is white.

Figure 2:
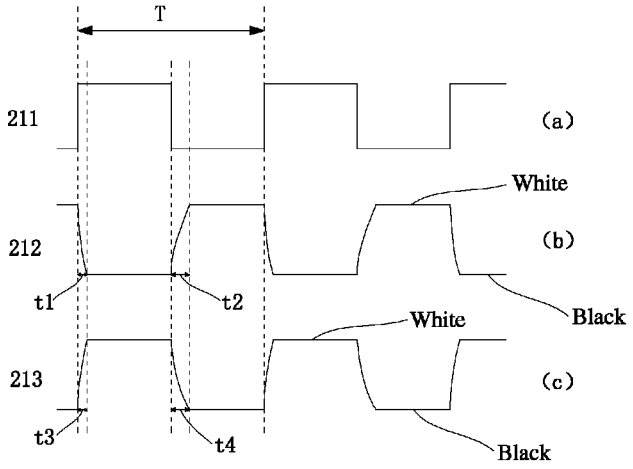
FIG. 2 is a waveform diagram of the normally white cell and the normally black cell.

FIG. 2 is a waveform diagram of the normally white cell and normally black cell. FIG. 2*a* is a waveform diagram of the driving voltage 211. FIG. 2*b* is a waveform diagram showing the display brightness 212 of the normally white cell. FIG. 2*c* is a waveform diagram showing the display brightness 212 of the normally black cell. In FIG. 2, x-axis represents the time, and y-axis represents the change of the display brightness.

In order to illustrate the difference, the same driving voltage 211 is adopted to drive the normally white cell and the normally black cell. It is to be understood that other driving voltage may be adopted also. The driving voltage 211 may be a wave having a time period T, which indicates the time needed to display one frame for the normally white cell or the normally black cell.

When the driving voltage 211 transforms from a low voltage to a high voltage along a rising edge, the display brightness 212 of the normally white cell transforms from the white to black. As the capacity of the liquid crystal and storage capacitor is huge, it takes time to accumulate the electrical charge. The above mentioned "time" is generally referred to as the "response time." In FIG. 2, t1 refers to the response time of the normally white cell. When the driving voltage 211 transforms from the high voltage to the low voltage along the falling edge, the display brightness 212 of the normally white cell transforms from black to white. Similarly, the discharging process also needs the same "response time" for transforming the black to white, which is indicated by t2 in FIG. 2. It can be understood that the response time t1 is smaller than the response time t2 for the normally white cell. Thus, it takes longer for the normally white cell to transform from white to black than to transform from black to white.

When the driving voltage 211 transforms from the low voltage to the high voltage along the rising edge, the display brightness 213 of the normally black cell transforms from the black to white. For the display brightness 213 of the normally black cell, the process of transforming from black to white needs the response time t3. When the driving voltage 211 transforms from the high voltage to the low voltage along the falling edge, the display brightness 213 of the normally black cell transforms from white to black. Similarly, the process of transforming from white to black needs the response time t4. It can be understood that the response time t3 is smaller than the response time t4 for the normally white cell. That is, it takes longer for the normally black cell to transform from white to black than to transform from black to white.

In one embodiment, a mixed LC cell includes the normally white cell and the normally black cell. The white-to-black transformation is controlled by the normally white cell, and the black-to-white transformation is controlled by the normally black cell. It is to be noted that the response time of the mixed LC cell is shorter than the normally white cell or the normally black cell.

Figure 3:
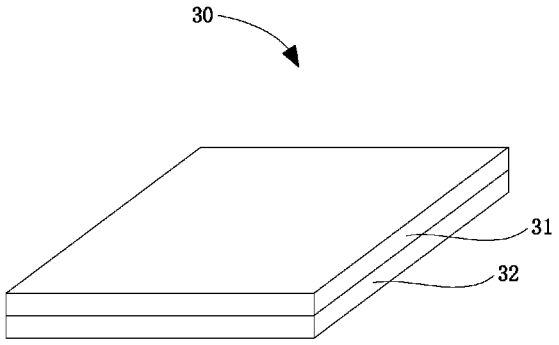
FIG. 3 is a schematic view of the mixed LC cell including the normally white cell and the normally black cell in accordance with one embodiment.

FIG. 3 is a schematic view of the mixed LC cell. As shown, the mixed LC cell 30 includes a first LC cell 31 and a second LC cell 32 arranged opposite to the first LC cell 31. The first LC cell 31 is the normally white cell of FIG. 1*a*, and the second LC cell 32 is the normally black cell of FIG. 1*b*. During the displaying process, the display brightness of the first LC cell 31 transforms from white to black, and that of the second LC cell 32 transforms from black to white.

It is to be noted that the first LC cell 31 may be the normally black cell of FIG. 1*b*, and the second LC cell 32 may be the normally white cell of FIG. 1*a*.

Figure 4:
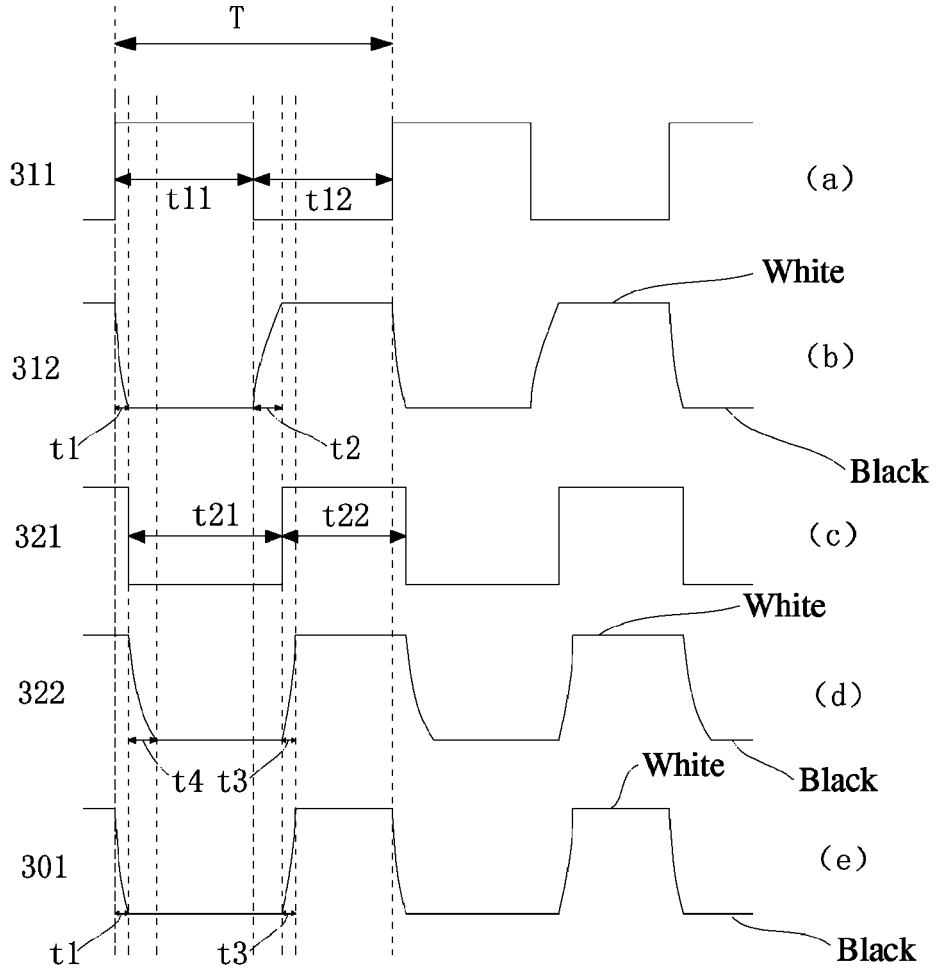
FIG. 4 is a waveform diagram of the liquid crystal cell of FIG. 3.

FIG. 4 is a waveform diagram of the liquid crystal cell of FIG. 3. FIGS. 4*a* and 4*c* are waveform diagrams of the driving voltage 311, 321 respectively for the first LC cell 31 and the second LC cell 32. In FIG. 4, x-axis represents the time, and y-axis represents the change of the voltage. FIGS. 4*b* and 4*d* are waveform diagrams respectively showing the display brightness 312, 322 of the first LC cell 31 and the second LC cell 32. FIG. 4*e* is a waveform diagram showing the display brightness 301 of the mixed LC cell 30. In FIGS. 4*b*, 4*d* and 4*e*, x-axis represents the time, and y-axis represents the change of the display brightness.

As shown in FIG. 4, the driving voltage 311, 321 are waves having a time period T. The changes of the display brightness 301 of the LC cell 30 during one time period T will be described. When the driving voltage 311 transforms from the low voltage to the high voltage along the rising edge, the display brightness 312 of the first LC cell 31 transforms from white to black with the response time t1. At this moment, the driving voltage 321 is high, and the display brightness 322 of the second LC cell 32 is white. The transformation of the display brightness 301 of the mixed LC cell 30 is the same with that of the display brightness 312 of the first LC cell 31, that is, the white-to-black transformation. And the response time is t1. When the driving voltage 321 transforms from the low voltage to the high voltage along the rising edge, the display brightness 322 of the second LC cell 32 transforms from black to white with the response time t3. At this moment, the driving voltage 321 is low, and the display brightness 312 of the first LC cell 31 is white. The transformation of the display brightness 301 of the mixed LC cell 30 is the same with that of the display brightness 322 of the second LC cell 32, that is, the black-to-white transformation. And the response time is t3.

When the driving voltage 311 transforms from the high voltage to the low voltage along the falling edge, the display brightness 312 of the first LC cell 31 transforms from black to white transformation with the response time t2. At this moment, the driving voltage 321 is low, and the display brightness 322 of the second LC cell 32 is black. The display brightness 301 of the mixed LC cell 30 is black.

When the driving voltage 321 transforms from the high voltage to the low voltage along the falling edge, the display brightness 322 of the second LC cell 32 transforms from white to black with the response time t4. At this moment, the driving voltage 311 is high, and the display brightness 312 of the first LC cell 31 is black. The display brightness 301 of the mixed LC cell 30 is black. That is to say, when the driving voltage 311 is high or the driving voltage 321 is low, the display brightness 301 of the mixed LC cell 30 is black. On the other hand, when the driving voltage 311 is low or the driving voltage 321 is high, the display brightness 301 of the mixed LC cell 30 is white.

The mixed LC cell 30 displays one frame within one time period T by adopting the above driving process. Comparing to the first LC cell 31 and the second LC cell 32, the response time of the display brightness 301 of the mixed LC cell 30 is shortened. In addition, one black frame is inserted between two consecutive white frames when the mixed LC cell 30 displays. In this way, the impulsive driving method is accomplished and the display burin-in and blur effects are eliminated in an efficiency way.

In the embodiment, the driving voltage 311 of the first LC cell remains at a high level for a first high time period t11 and remains at a low level for a first low time period t12. The first high time period t11 equals to the first low time period t12. The driving voltage 322 of the second LC cell remains at the high level for a second high time period t21 and remains at the low level for a second low time period t22. The second high time period t21 has to be shorter than the second low time period t22. Specifically, the second high time period t21 equals to the second low time period t22 and to the response time t4 for which the display brightness 312 of the second LC cell 32 transforms from white to black.

It is to be noted that the driving voltage 311 and the driving voltage 321 are independent. That is to say, the first LC cell 31 and the second LC cell 32 are independently controlled. As such, the time period of the driving voltage 311 and the driving voltage 321 may be different. In addition, the first high time period, the first low time period, the second high time period, and the second low time period of the driving voltage 311 and the driving voltage 321 may be adjusted.

Figure 5:
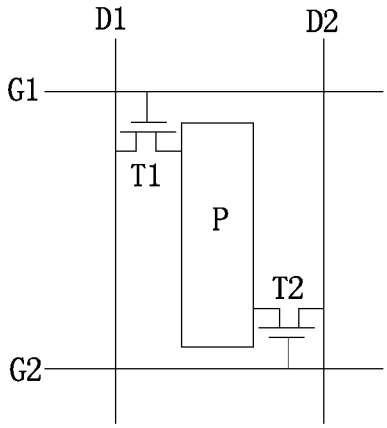
FIG. 5 is a block diagram of the pixel driving circuit of the LC cell of FIG. 3.

FIG. 5 is a block diagram of the pixel driving circuit of the LC cell of FIG. 3. As the same pixel driving circuit is adopted by the first LC cell 31 and the second LC cell 32, only one driving circuit for one pixel (P) is taken as the illustrative example. In one embodiment, the first LC cell 31 and the second LC cell 32 includes a plurality of pixels (as shown in FIG. 5) arranged in the matrix form.

Referring to FIGS. 5 and 3, in order to efficiently charge the voltage to the plurality of pixels (P) in the first LC cell 31 and the second LC cell 32, preferably, each of the pixel (P) is driven by two gate lines (G1, G2) and two data lines (D1, D2). A first gate line (G1) turns on a gate of a first transistor (T1) and a first data line (D1) provides data voltage to the pixels (P) by a source of the first transistor (T1) when the display brightness of the mixed LC cell 30 transforms from white to black. A second gate line (G2) turns on a gate of a second transistor (T2) and a second data line (D2) provides the data voltage to the pixel (P) by a source of the second transistor (T2) when the display brightness of the mixed LC cell 30 transforms from black to white. The response time of the pixel driving circuit matches the response time of the LC such that the mixed LC cell 30 obtains a quicker response.

Figure 6:
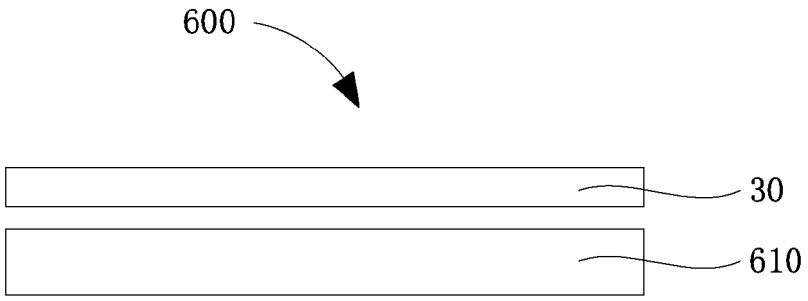
FIG. 6 is a schematic view of the LCD in accordance with one embodiment.

FIG. 6 is a schematic view of the LCD in accordance with one embodiment.

Referring to FIGS. 6 and 3, a liquid crystal display 600 includes a mixed LC cell 30 and a backlight module 610 arranged opposite to the mixed LC cell 30. The backlight module 610 supplies light to the mixed LC cell 30 such that the mixed LC cell 30 can display images.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A liquid crystal (LC) cell, comprising:

a first LC cell and a second LC cell arranged opposite to the first LC cell, wherein the first LC cell is a normally white cell, and the second LC cell is a normally black cell; and wherein the LC cell comprises a plurality of pixels arranged in a matrix form, each of the pixels being configured with a first transistor and a second transistor, and each of the pixels is driven by two gate lines and two data lines, a first gate line turns on a gate of the first transistor and a first data line provides data voltage to the pixels by a source of the first transistor when the display brightness of the LC cell transforms from white to black, and a second gate line turns on a gate of the second transistor and a second data line provides the data voltage to the pixel by a source of the second transistor when the display brightness of the LC cell transforms from black to white; and wherein a time period for the diving voltage of the first LC cell is the same with that of the second LC cell, the driving voltage of the first LC cell remains at a high level for a first high time period and remains at a low level for a first low time period, the driving voltage of the second LC cell remains at the high level for a second high time period and remains at the low level for a second low time period, when the first high time period equals the first low time period, the second high time period equals to a sum of the second low time period and a response time for which the display brightness of the second LC cell transforms from white to black.

2. The LC cell as claimed in claim 1, wherein a display brightness of the second LC cell is white when the display brightness of the first LC cell transforms from white to black, and the display brightness of the second LC cell is black when the display brightness of the first LC cell transforms from black to white.

3. The LC cell as claimed in claim 2, wherein the display brightness of the first LC cell is white when the display brightness of the second LC cell transforms from black to white, and the display brightness of the first LC cell is black when the display brightness of the second LC cell transforms from white to black.

4. The LC cell as claimed in claim 1, wherein the display brightness of the first LC cell is white when the display brightness of the second LC cell transforms from black to white, and the display brightness of the first LC cell is black when the display brightness of the second LC cell transforms from white to black.

5. A liquid crystal display, comprising:

a liquid crystal (LC) cell and a backlight module arranged opposite to the LC cell, the backlight module supplies light to the LC cell, and the LC cell comprises a first LC cell and a second LC cell arranged opposite to the first LC cell, wherein the first LC cell is a normally white cell, and the second LC cell is a normally black cell; and wherein the LC cell comprises a plurality of pixels arranged in a matrix form, each of the pixels being configured with a first transistor and a second transistor, and each of the pixels is driven by two gate lines and two data lines, a first gate line turns on a gate of the first transistor and a first data line provides data voltage to the pixels by a source of the first transistor when the display brightness of the LC cell transforms from white to black, and a second gate line turns on a gate of the second transistor and a second data line provides the data voltage to the pixel by a source of the second transistor when the display brightness of the LC cell transforms from black to white; and wherein a time period for the diving voltage of the first LC cell is the same with that of the second LC cell, the driving voltage of the first LC cell remains at a high level for a first high time period and remains at a low level for a first low time period, the driving voltage of the second LC cell remains at the high level for a second high time period and remains at the low level for a second low time period, when the first high time period equals the first low time period, the second high time period equals to a sum of the second low time period and a response time for which the display brightness of the second LC cell transforms from white to black.

6. The liquid crystal display as claimed in claim 5, wherein a display brightness of the second LC cell is white when the display brightness of the first LC cell transforms from white to black, and the display brightness of the second LC cell is black when the display brightness of the first LC cell transforms from black to white.

7. The liquid crystal display as claimed in claim 6, wherein the display brightness of the first LC cell is white when the display brightness of the second LC cell transforms from black to white, and the display brightness of the first LC cell is black when the display brightness of the second LC cell transforms from white to black.

8. The liquid crystal display as claimed in claim 5, wherein the display brightness of the first LC cell is white when the display brightness of the second LC cell transforms from black to white, and the display brightness of the first LC cell is black when the display brightness of the second LC cell transforms from white to black.

* * * * *